United States Patent [19]

Pahl

[11] 4,243,854

[45] Jan. 6, 1981

[54] QUICK-BREAK ATTACHMENT FOR A POLE-TOP AIR-BREAK SWITCH

[76] Inventor: Richard B. Pahl, P.O. Box 8485, Stockton, Calif. 95208

[21] Appl. No.: 91,104

[22] Filed: Nov. 5, 1979

Related U.S. Application Data

[63] Continuation of Ser. No. 2,999, Jan. 12, 1979, abandoned.

[51] Int. Cl.[3] ..... H01H 31/00

[52] U.S. Cl. ..... 200/48 R; 200/48 A; 200/288

[58] Field of Search ..... 200/48 R, 48 P, 48 A, 200/48 V, 48 KB, 48 CB, 48 SB, 49, 288

[56] References Cited

U.S. PATENT DOCUMENTS

| | | | |
|---|---|---|---|
| 2,750,460 | 6/1956 | Kast | 200/48 A |
| 2,769,063 | 10/1956 | Lingal | 200/48 R |
| 2,849,578 | 8/1958 | Hart | 200/48 R |
| 2,873,325 | 2/1959 | Kelly | 200/48 R |
| 2,886,663 | 5/1959 | Powell | 200/48 R |
| 2,953,655 | 9/1960 | Warner et al. | 200/48 SB |
| 2,988,610 | 6/1961 | Bernatt | 200/48 A |
| 3,005,063 | 10/1961 | Zemels et al. | 200/48 SB |
| 3,032,632 | 5/1962 | Beach et al. | 200/48 SB |
| 3,079,474 | 2/1963 | Beach et al. | 200/48 R |
| 3,175,054 | 3/1965 | Schwager et al. | 200/48 R |
| 3,217,115 | 11/1965 | Kaplan | 200/48 R |
| 3,244,825 | 4/1966 | Killian et al. | 200/48 R |
| 3,488,752 | 1/1970 | Burton et al. | 200/48 R |

FOREIGN PATENT DOCUMENTS

| | | | |
|---|---|---|---|
| 1098147 | 1/1968 | United Kingdom | 200/288 |

*Primary Examiner*—John W. Shepperd
*Attorney, Agent, or Firm*—Roger B. Webster

[57] ABSTRACT

Improvements in a quick-break attachment, for a pole-top air-break switch, wherein said attachment is of the type including a whip engaged in a catch to maintain a protective, anti-arcing shunt across the switch until the latter opens, whereupon the whip disengages and quick-breaks from the catch; the improvements consisting of instrumentalities which, firstly, assure of substantial acceleration in speed of the whip after its disengagement but before actual electrical separation occurs, and, secondly, prevent rebound of the disengaged whip into arcing contact with the catch.

9 Claims, 9 Drawing Figures

30
31
32
29
11
7
2
4
6
5
10
8
19
15
16
18
13
12
17

-4-
19
14
8
15
13
20
16
18
35
12
36
34
31
32
33
17

19
8
14
13
15
20
12
16
18
31
36
32
34
33
21
22
17
23
24
28
25
26
27

8
12
13
14
15
16
17
18
19
20
21
22
23
24
25
26
27
28
29
30
31
32
33
34
35
36
-6-

QUICK-BREAK ATTACHMENT FOR A POLE-TOP AIR-BREAK SWITCH

CONTINUITY OF APPLICATIONS

This application is a continuation and claims the priority of application Ser. No. 2,999, filed Jan. 12, 1979 now abandoned.

BACKGROUND OF THE INVENTION

1. Field of the Invention

To prevent arcing and damage to the primary contacts of a pole-top, air-break switch upon opening thereof, there is commonly employed a device which provides a shunt across the switch during the period of disengagement of such primary contacts to open the switch; such device—known as a quick-break attachment—includes, in one form, a flexible and resilient whip on one switch part, and which whip is engaged with a catch on another switch part to establish the shunt upon initial relative separating movement of said switch parts to disengage said primary contacts; the whip being bowed and hence spring-loaded in response to such movement, and—upon continuance thereof—snaps free or quick-breaks from the catch and terminates the shunt.

The known quick-break attachments have encountered certain problems, among them the fact that the speed of the break of the whip from the catch was not sufficiently fast to prevent the propagation of a damaging arc, and at times the whip, after breaking from the catch, rebounded and made undesirable arcing contact with said catch. The present invention was conceived in a successful effort to provide an improved quick-break attachment, and which, in particular, is not subject to the above-mentioned problems.

The Prior Art

Applicant is not aware of any issued U.S. patent, or other prior art, disclosing the structure and function of the improved quick-break attachment shown and claimed herein: U.S. Pat. Nos. 2,873,325; 2,886,663; 3,079,474; 3,175,054; 3,217,115; 3,244,825 and 3,488,752 being representative of the prior art known to applicant

SUMMARY OF THE INVENTION

The present invention relates to, and it is a major object to provide, improvements in a quick-break attachment, for a pole-top air-break switch, wherein said attachment is of the type wherein a flexible and resilient whip on one switch part is normally engaged in a catch on another switch part, and is bowed and hence spring-loaded in response to initial relative separating movement of said switch parts as requisite to disengagement of the primary contacts of and to open the switch; the whip and engaged catch then providing a shunt across the switch to prevent otherwise damaging arcing at said primary contacts as the switch opens, and thereafter, with continued relative separating movement of said switch parts, the bowed, spring-loaded whip snap-disengages from the catch and quick-breaks the shunt, and which completes opening of the circuit in which the switch is interposed.

The present invention provides, as another important object, a quick-break attachment, of the type for the purpose described, in which said improvements consist of an associated spring arrangement which increases the loading of the whip when in bowed, shunt mode and desirably accelerates the speed of snap-disengagement of the whip from the catch; the bowed whip, after such disengagement and as it spring-unloads and straightens, remaining for a distance in sliding, electrical contact with an extended portion of the catch so that said spring-unloading whip further accelerates in speed before actual electrical separation occurs—all whereby to reduce to an extreme minimum, and substantially outrun, the propagation of a damaging arc at the moment of said electrical separation.

Additionally, there is provided, in cooperation with the spring arrangement, a shock absorber unit which prevents rebound of the whip after it snap-disengages from the catch and spring-unloads, and which rebound could possibly cause re-contact with, and damaging arcing at, the catch.

The present invention provides, as a further object, a quick-break attachment which is designed for ease and economy of manufacture.

The present invention provides, as a still further object, a practical and reliable quick-break attachment, and one which is exceedingly effective for the purpose for which it is designed.

DESCRIPTION OF THE PREFERRED EMBODIMENT

Figure 1:
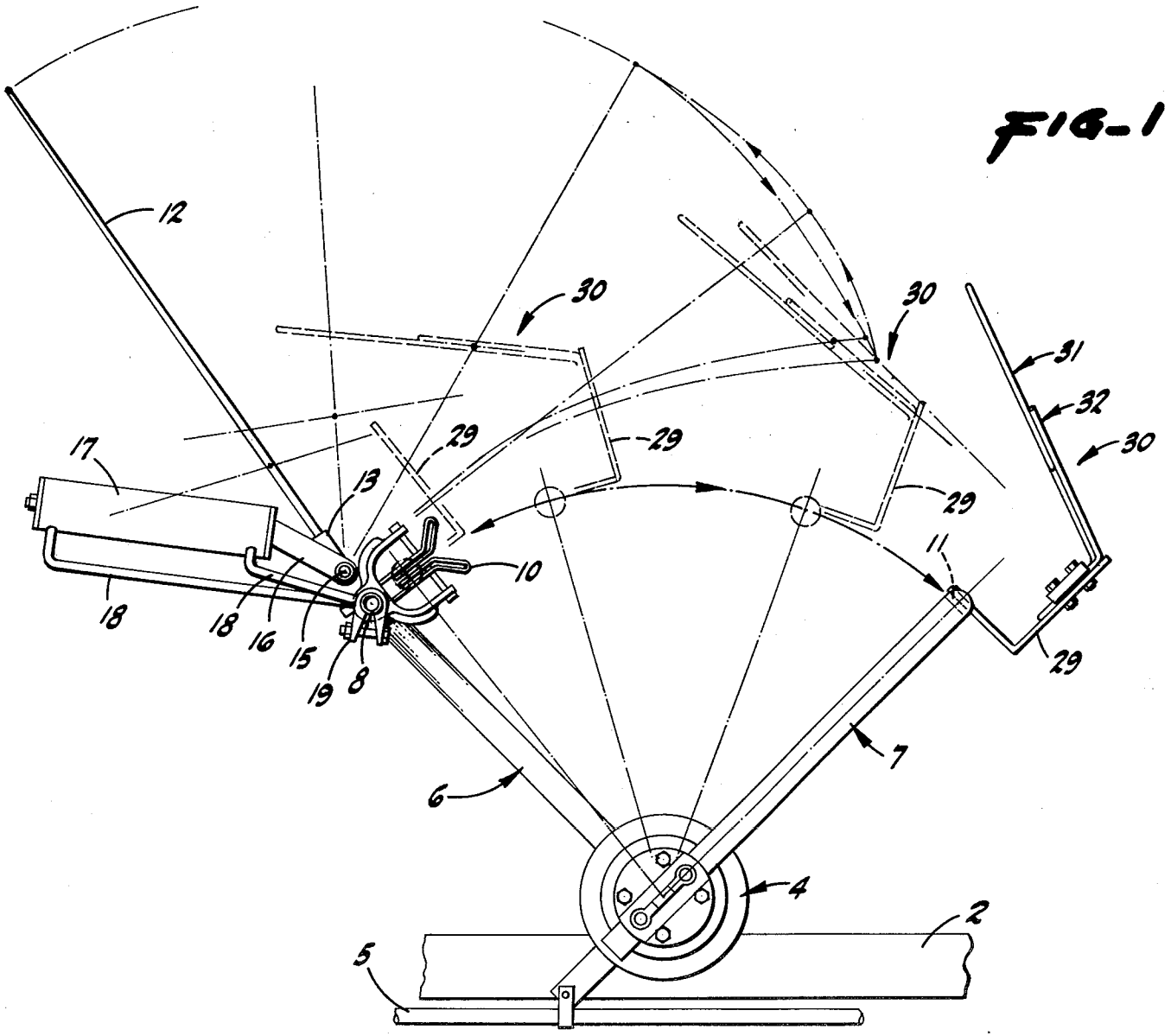
FIG. 1 is a side elevation of a pole-top, air-break switch fitted with the improved quick-break attachment; the switch being shown in open position, and successive positions—as the switch opens—of the whip and catch are indicated in broken lines.
Figure 2:
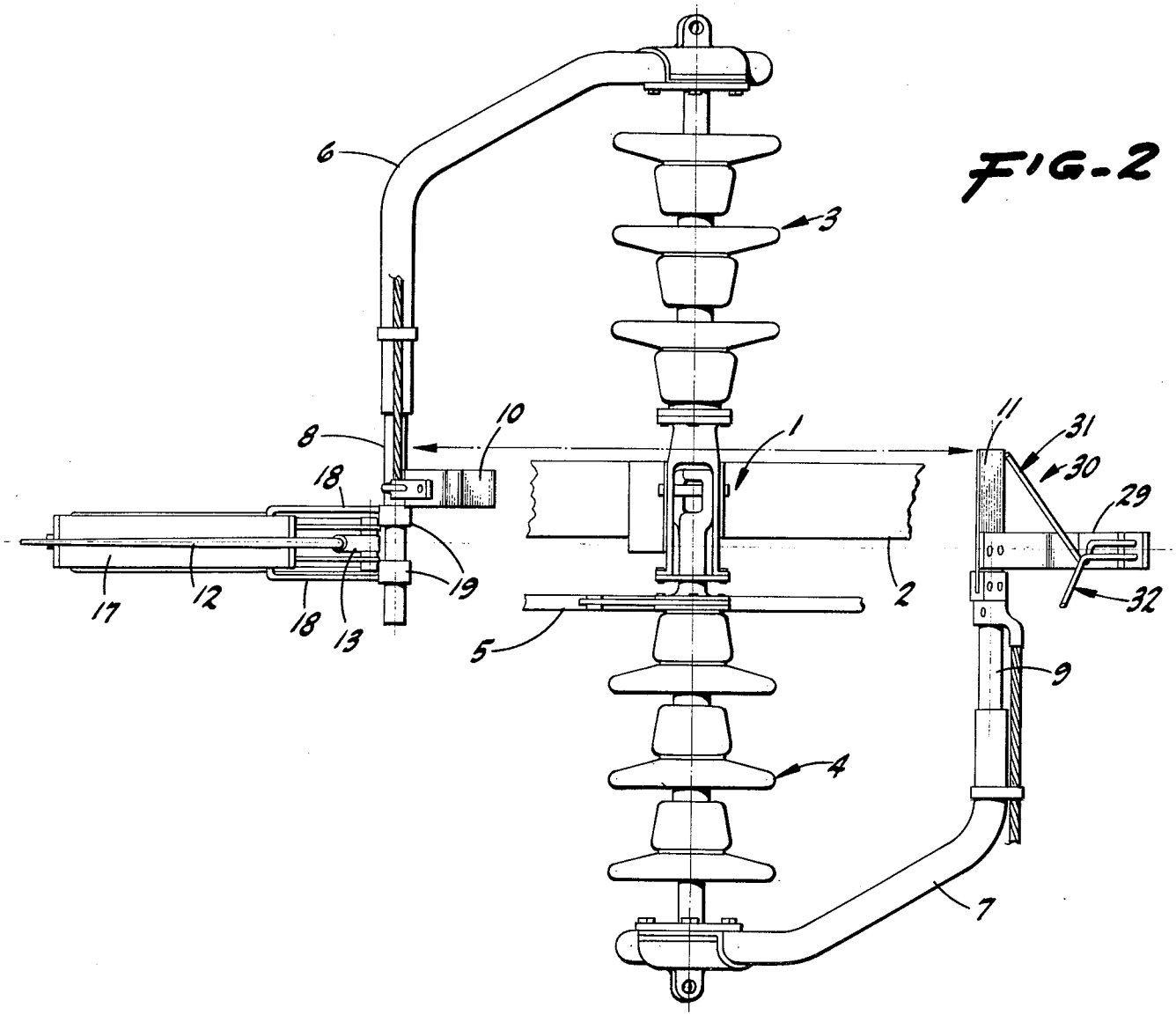
FIG. 2 is a plan view of the switch and quick-break attachment thereon; the switch being shown in open position.
Figure 3:
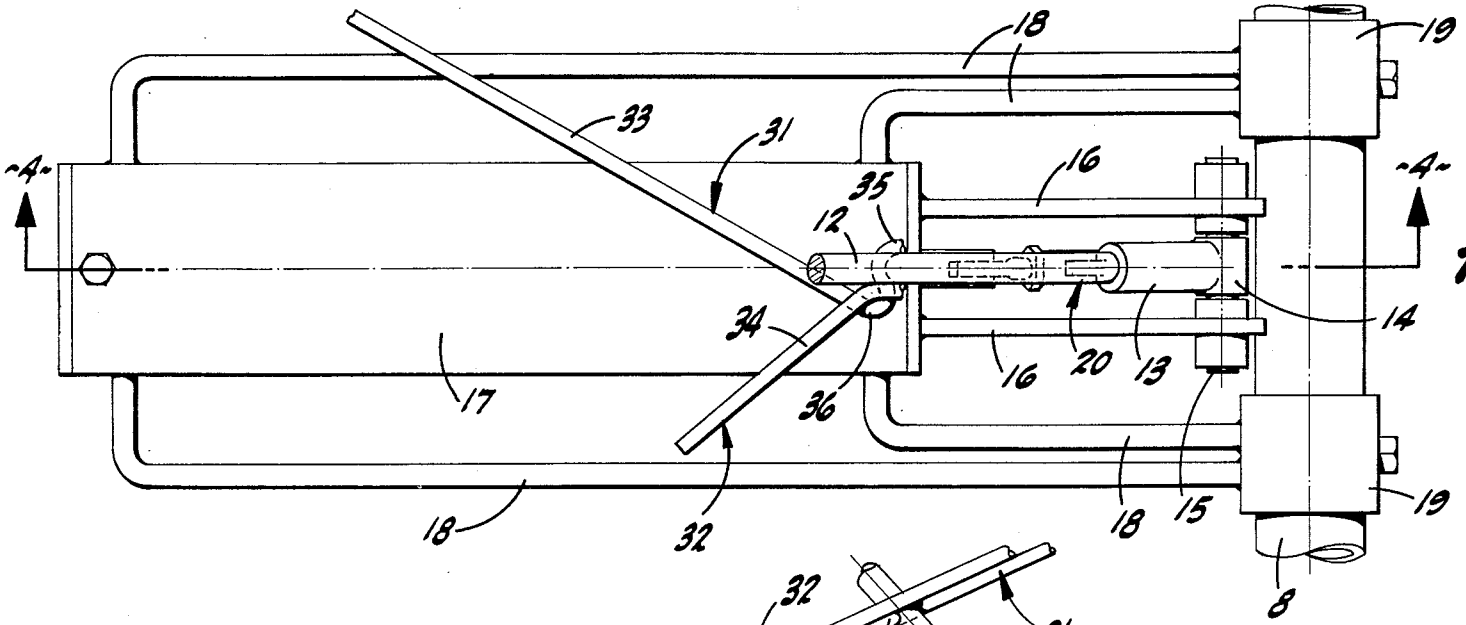
FIG. 3 is an enlarged, fragmentary plan view showing the mount for the whip, with the latter as engaged in the catch when the switch is closed; the whip and catch being partially broken away.

Referring now more particularly to the drawings and to the characters of reference marked thereon, the present quick-break attachment is here shown as employed in connection with a pole-top, air-break switch of conventional construction, and which includes the following:

A mount 1 is secured on a cross arm 2 of a pole (not shown), and opposed insulator stacks 3 and 4 are attached to, and project outwardly from, the mount 1; the insulator stack 3 being fixed, while the insulator stack 4 is part-circle rotatable about its axis and from the ground by an operating mechanism shown in part at 5.

At the outer end thereof, the insulator stacks 3 and 4 are secured to, and support, a corresponding switch arm, and which are indicated generally at 6 and 7; such switch arms—as usual—including opposed, spaced apart, parallel end portions 8 and 9, respectively. The end portion 8 is fitted with a clip 10, while the end portion 9 carries a mating blade 11. In the open position of the switch, the switch arms 6 and 7 are in upwardly divergent relation, and the clip 10 and blade 11 are disengaged and widely separated. However, when the switch is closed by arcuate, part-circle swinging of switch arm 7 toward the switch arm 6 and by rotating insulator stack 4, the blade 11 engages in the clip 10, and which completes the circuit through the switch. Conversely, and to open the switch, the switch arm 7 is swung arcuately and part-circle in the opposite direction; i.e., away from switch arm 6, and which separates the blade 11 from clip 10. Unless a protective shunt arrangement is provided on the switch, a damaging arc occurs when the blade escapes the clip; such protection being conventionally afforded by a whip and catch-type of quick-break attachment as hereinbefore described.

The present invention provides an improved whip and catch-type, quick-break attachment, and which is constructed and function as follows:

An upstanding, elongated, tapered, flexible but resilient, metal whip 12—preferably of spring aluminum—is secured at its lower end in a socket 13 fixed, at its lower end, on a transverse sleeve 14 turnably engaged on a cross shaft 15 which spans between transversely-spaced support arms 16 which project—toward the end portion 8 of switch arm 6—from a cylinder 17 disposed adjacent but away from said end portion 8 and extending lengthwise in the direction of swinging movement of the switch arm 7. The cylinder 17 is secured in fixed position by a rod array 18 which extends from such cylinder to connection with clamps 19 on the end portion 8 of switch arm 6 adjacent the clip 10.

As so mounted, the whip 12 is disposed for swinging motion in the vertical, longitudinal plane of the switch; i.e., in a vertical plane at a right angle to the axis of rotation of switch arm 7.

The whip 12 is connected, by a dual-pivot link 20, to the outer end of a pull rod 21 which projects axially from the near end of cylinder 17; such pull rod—within the front portion of said cylinder—being surrounded with a heavy-duty, helical compression spring 22 which is engaged between the head of the cylinder and a radial stop disc 23 fixed on pull rod 21 adjacent its inner end.

Figure 4:
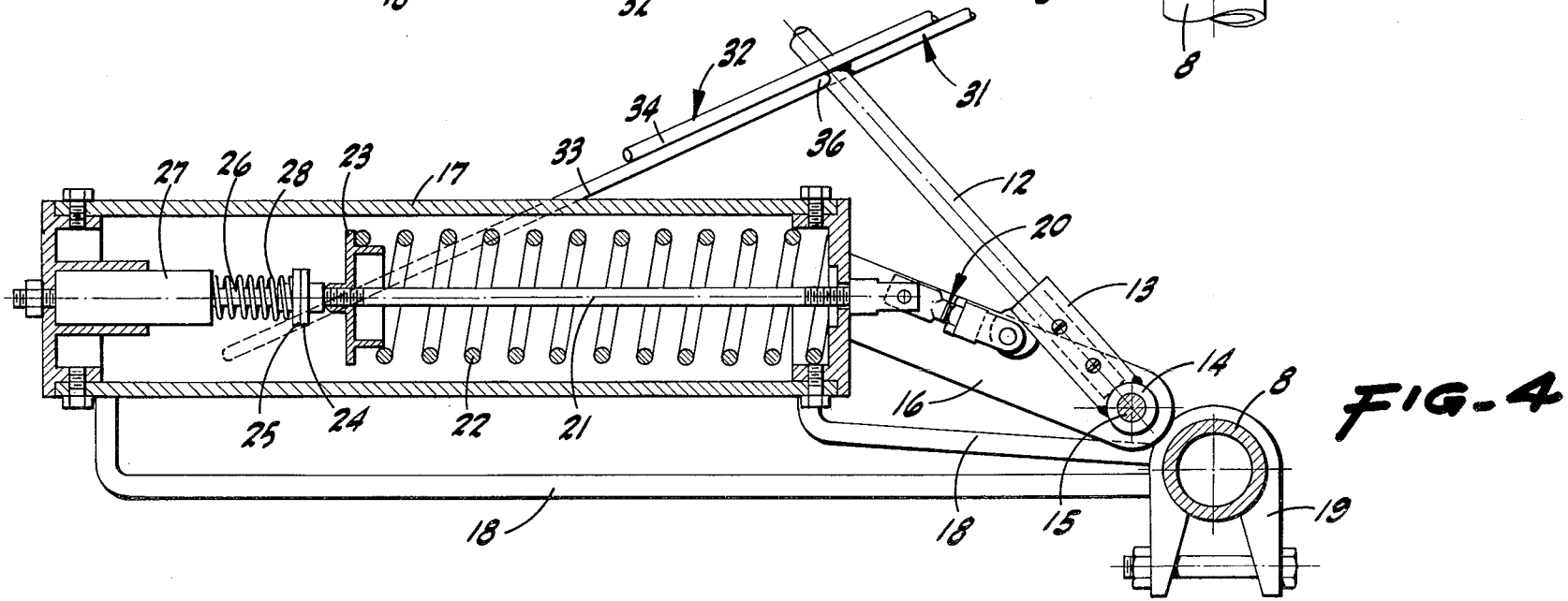
FIG. 4 is a longitudinal sectional elevation of such mount and including a showing of the compression spring extended and the associated shock absorber unit in its then-contracted position; the view being taken substantially on line 4—4 of FIG. 3.

At said inner end of the pull rod 21, it is fitted with a radial pad 24 which normally engages a corresponding or mating pad 25 on the near end of the spindle 26 of a hydraulic-type shock absorber unit 27 mounted axially in the rear portion of cylinder 17. When the pads 24–25 are in normal engagement, the shock absorber unit is in contracted position with its spring 28 compressed. See FIG. 4.

Figures 5, 6:
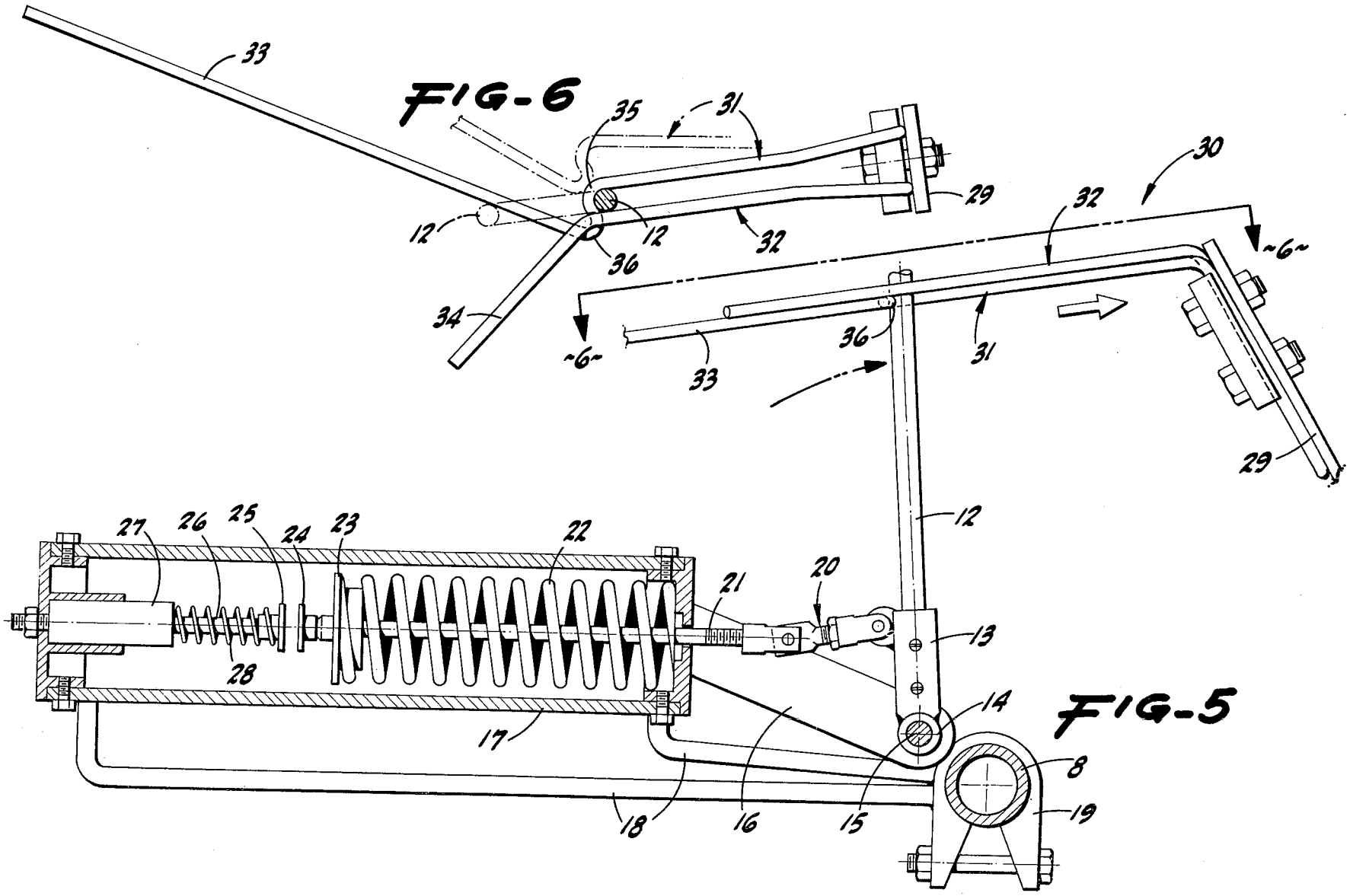
FIG. 5 is a view similar to FIG. 4, but shows the spring as partially compressed upon initial movement of the catch and whip as the switch is being opened; the shock absorber unit then being in its fully expanded, clearance position.
FIG. 6 is a fragmentary plan view taken substantially on line 6—6 of FIG. 5.

It will be recognized that—upon the whip being initially swung forwardly, as hereinafter appears, from a normal upstanding position inclined away from switch arm 7—the spring 22, through the medium of link 20 and rod 21, is partially contracted and placed under corresponding compression, and at the same time the pads 24–25 separate, whereby the shock absorber unit expands to a shock-receiving position. See FIG. 5.

Adjacent the blade 11, the end portion 9 of switch arm 7 is fitted with an upstanding bracket 29 on which is mounted an upstanding catch, indicated generally at 30, adapted for engagement with the whip 12 when the switch is closed; the catch 30, when the switch is open, inclining upwardly in the direction of the whip 12, the catch whip then being in substantial parallelism but widely spaced apart.

The catch 30 comprises a pair of side-by-side but laterally spaced rods 31 and 32 having outer end portions which form fingers 33 and 34, respectively, which diverge in an outward direction; the rods 31 and 32, and particularly their fingers 33 and 34, are resilient and capable of being sprung laterally and then returning to normal positions.

At the inner end of finger 33, the rod 31 is formed with an S-shaped bend which provides an arcuate catch cradle 35 facing in a direction away from the whip and a half-loop 36 which normally underlies the rod 32 at the inner end of finger 34.

Upon swinging of the switch arm 7 toward the switch arm 6 until the switch arm end portion 9 occupies a position close to, but spaced in parallelism from, the switch arm end portion 8, the blade 11 engages in the clip 10, and the switch is thus closed. At the same time, the catch 30 swings toward and engages the whip 12; this being accomplished by the whip 12 first striking the finger 34 and deflecting it laterally outwardly beyond the loop 36 whereby the whip passes such loop, enters the catch cradle 35, and rests in the latter at a point intermediate the ends of said whip. This is the normal position of the parts of the quick-break attachment when the switch is closed.

Upon opening of the switch by swinging of the switch arm 7 away from the switch arm 6, the blade 11 escapes the clip 10; the whip 12 remaining in engagement with the catch 30 to provide the desired shunt at least until the blade 11 is clear of, and substantially spaced from, the clip 10.

More particularly, when—upon opening of the switch as above—the switch arm 7 swings away from the switch arm 6, the whip 12 is drawn forward with, and bowed by, the catch 30; this spring-loading the whip, and which spring-loading is enhanced by the compression of the spring 22 as the whip pivots forward about its axis and imparts spring-compressing movement to link 20 and pull rod 21.

Figure 7:
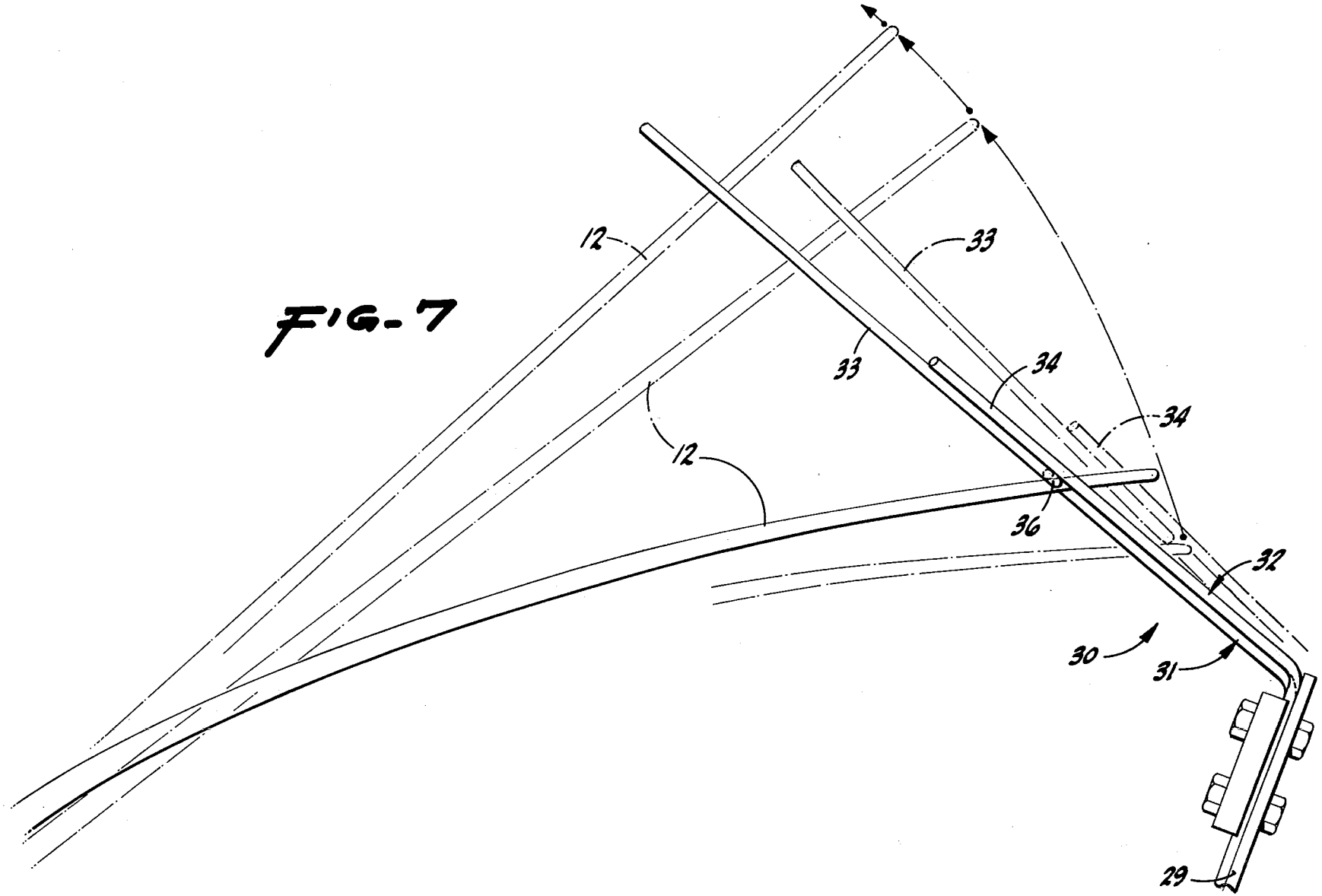
FIG. 7 is a schematic view showing, essentially in side elevation, successive positions of the whip immediately before and after the whip snap-disengages from the catch.
Figure 9:
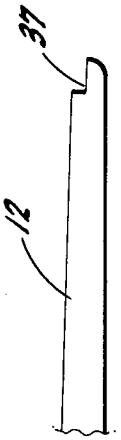
FIG. 9 is a fragmentary view showing the notched outer end portion of the whip.

Thus, as the switch arm 7 swings in switch-opening direction, the whip 12 is progressively and heavily spring-loaded, and so continues as the switch arm 7 moves to its switch-open position, and which movement is accompanied by corresponding lengthwise sliding of the bowed whip 12 in catch cradle 35 in a direction toward the outer end of said whip, and which permits the latter—when its tip is reached—to snap-disengage from said catch cradle 35 a moment before the switch arm reaches said switch-open position. Such positional movement of the whip—in successive stages—is shown schematically in FIG. 7. As shown, the laterally outwardly divergent finger 33, which is of substantial length, normally lies in a position diagonally of, and in intersecting relation to, the path of movement of the whip 12 after it snap-disengages from the catch cradle 35.

Figure 8:
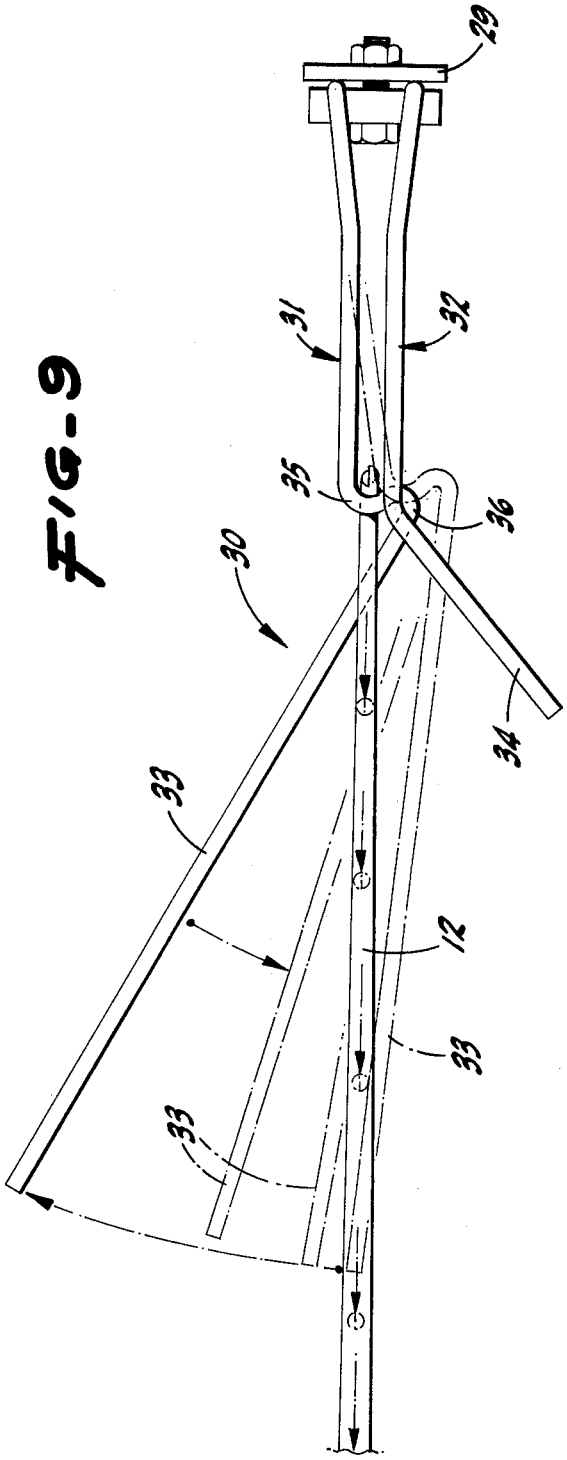
FIG. 8 is a schematic view showing, essentially in plan, the position of the whip at substantially the point of snap-disengagement from the catch, and successive positions of the whip after such disengagement.

When the whip so snap-disengages from the catch cradle 35, the whip—as it unloads and straightens—then instantly engages and rides the laterally outwardly side of said diagonally positioned finger 33 (causing it to deflect inwardly) until the whip escapes the outer end of said finger 33. This not only maintains the whip and catch in shunt relation beyond the time of escape of the whip 12 from catch cradle 35 and hence; longer than otherwise possible, but also permits the whip—as it unloads and straightens (under the influence of its own spring-loading and that of spring 22)—to substantially accelerate in speed before electrical separation finally occurs between the whip and the finger 33 and at which time the shunt is broken. Such accelerated speed assures against the propagation of any damaging arc as the whip electrically separates from the finger 33. The positional movement of the whip—at substantially the point of snap-disengagement and at successive subsequent stages—is shown schematically in FIG. 8.

The outer end or tip of the whip 12 is notched, as at 37, to produce an air vortex as the whip spring-unloads and straightens, and which air vortex further assures against arc propagation.

It will also be recognized that, when the whip spring-unloads and straightens, there is—in the absence of preventive means—a tendency of the whip to thereafter rebound and undesirably recontact the catch 30. This is effectively prevented—in the present quick-break attachment—by the provision of the shock absorber unit 27.

When the spring 22 unloads (with the whip) and elongates, the pads 24–25 engage, and the shock absorber unit 27 is contracted, and which decelerates the elongating movement of said spring 22 and consequently damps any tendency of the whip to rebound.

While the apparatus of the present invention is described as an improved quick-break attachment for an air-break pole-top switch, it is to be recognized that—by reason of the structure and function thereof as hereinbefore described—such apparatus accomplishes a circuit break which is exceedingly high speed in comparison to known quick-break attachments. Hence, the present apparatus can properly be characterized as a high-speed break attachment.

From the foregoing description, it will be readily seen that there has been produced such a quick-break attachment as substantially fulfills the objects of the invention as set forth herein.

While this specification sets forth in detail the present and preferred construction of the quick-break attachment, still in practice such deviations from such detail may be resorted to as do not form a departure from the spirit of the invention as defined by the appended claims.

I claim:

1. An improved quick-break attachment for a pole-top air-break switch which includes a fixed switch arm and a movable switch arm in normally adjacent switch-closed relation, the movable switch arm being swingable in a direction away from the fixed switch arm to open the switch; the quick-break attachment comprising a flexible but resilient whip, means mounting the whip at its inner end and in connection with and projecting from the fixed switch arm, a catch including a cradle, and means fixedly mounting the catch in connection with and projecting from the movable arm, the whip being engaged with the catch cradle when the switch is closed, the whip being swung, bowed, and spring-loaded by the catch cradle, progressively sliding towards its tip on the catch cradle, and thence snap-disengaging at the tip from the catch cradle, all upon and in response to the movable switch arm swinging in said direction to open the switch; characterized by the inclusion of an elongated finger which projects from the catch cradle in a position intersecting the path of the whip beyond the point of its snap-disengagement from the catch cradle whereby after said snap-disengagement the whip spring-unloads, straightens, and engages and rides said intersecting finger, and hence prolongs electrical contact until the whip escapes said finger.

2. An improved quick-break attachment, as in claim 1, in which the intersecting finger is resilient and normally forwardly diagonal of said path of the whip as it spring-unloads whereby the whip deflects such finger laterally against the resiliency thereof and which assures of said electrical contact with the finger.

3. An improved quick-break attachment, as in claim 1, in which the whip is notched at the tip.

4. An improved quick-break attachment for a pole-top air-break switch which includes a fixed switch arm and a movable switch arm in normally adjacent switch-closed relation, the movable switch arm being swingable in a direction away from the fixed switch arm to open the switch; the quick-break attachment comprising a flexible but resilient whip, means pivotally mounting the whip at its inner end and in connection with and projecting from the fixed switch arm, a catch including a cradle, means fixedly mounting the catch in connection with and projecting from the movable arm, the whip being engaged with the catch cradle when the switch is closed, a spring, and means connecting the spring between the whip and the fixed switch arm, the spring yieldably resisting movement of the whip by the catch, the whip against the resistance of the spring being swung, bowed, and spring-loaded by the catch cradle, progressively sliding towards its tip on the catch cradle, and thence snap-disengaging at the tip from the catch cradle, all upon and in response to the movable switch arm swinging in said direction to open the switch; characterized by the inclusion of an elongated finger which projects from the catch cradle in a position intersecting the path of the whip beyond the point of its snap-disengagement from the catch cradle whereby after said snap-disengagement the whip spring-unloads, straightens, and engages and rides said intersecting finger, and hence prolongs electrical contact until the whip escapes said finger.

5. An improved quick-break attachment, as in claim 4, in which the spring is of compression type, and said spring-connecting means is arranged to shorten and load said compression spring when the ship is so swung, bowed, and spring loaded.

6. An improved quick-break attachment, as in claim 5, in which the compression spring unloads and lengthens upon the ship snap-disengaging from the catch cradle; there being an included shock absorber, and means mounting the shock absorber in connection with the spring-mounting means and in position to cooperate with the compression spring and damp said lengthening thereof whereby to prevent rebound of the whip toward the catch.

7. An improved quick-break attachment for a pole-top air-break switch which includes a fixed switch arm and a movable switch arm in normally adjacent switch-closed relation, the movable switch arm being swingable in a direction away from the fixed switch arm to open the switch; the quick-break attachment comprising a flexible but resilient whip, means pivotally mounting the whip at its inner end and in connection with and projecting from the fixed switch arms, a catch including a cradle, means fixedly mounting the catch in connection with and projecting from the movable arm, the whip being engaged with the catch cradle when the switch is closed, a spring, and means connecting the spring between the whip and the fixed switch arm, the spring yieldably resisting movement of the whip by the catch, the whip against the resistance of the spring being swung, bowed, and spring-loaded by the catch cradle, progressively sliding towards its tip on the catch cradle, and thence snap-disengaging at the tip from the catch cradle, all upon and in response to the movable switch arm swinging in said direction to open the switch; characterized by the spring being of compression type, and the connecting means for said compression spring including a cylinder, a structure fixing the cylinder in connection with but spaced from the fixed switch arm, the cylinder axis extending in the plane of said direction, the compression spring being disposed in the cylinder in engagement between the head thereof adjacent the whip and a stop disc in the cylinder, a pull rod extending from the stop disc and through said cylinder head, and a link pivotally connected between the exterior end of the pull rod and the whip at a point on the latter spaced outwardly of the axis of pivotal movement thereof; and further characterized by the inclusion of an elongated finger which projects from the catch cradle in a position intersecting the path of the whip beyond the point of its snap-disengagement from the catch cradle whereby after said snap-disengagement the whip spring-unloads, straightens, and engages and rides said intersecting finger, and hence prolongs electrical contact until the whip escapes said finger.

8. An improved quick-break attachment for a movable switch arm in normally adjacent switch-closed relation, the movable switch arm being swingable in a direction away from the fixed switch arm to open the switch; the quick-break attachment comprising a flexible but resilient whip, means pivotally mounting the whip at its inner end and in connection with and projecting from the fixed switch arm, a catch including a cradle, means fixedly mounting the catch in connection with and projecting from the movable arm, the whip being engaged with the catch cradle when the switch is closed, a spring, and means connecting the spring between the whip and the fixed switch arm, the spring yieldably resisting movement of the whip by the catch, the whip against the resistance of the spring being swung, bowed, and spring-loaded by the catch cradle, progressively sliding towards its tip on the catch cradle, and thence snap-disengaging at the tip from the catch cradle, all upon and in response to the movable switch arm swinging in said direction to open the switch; characterized by the spring being of compression type, and the connecting means for said compression spring including a cylinder, a structure fixing the cylinder in connection with but spaced from the fixed switch arm, the cylinder axis extending in the plane of said direction, the compression spring being disposed in the cylinder in engagement between the head thereof adjacent the whip and a stop disc in the cylinder, a pull rod extending from the stop disc and through said cylinder head, and a link pivotally connected between the exterior end of the pull rod and the whip at a point on the latter spaced outwardly of the axis of pivotal movement thereof; and further characterized by the pivotal mounting means for the whip including transversely spaced, support arms projecting toward the fixed switch arm from the head of the cylinder on opposite sides of the pull rod and connected link, a cross shaft spanning between the free ends of the support arms, a sleeve turnable on the cross shaft, and the lower end of the sleeve being attached in connection with said turnable sleeve.

9. An improved quick-break attachment, as in claim 8, including a socket extending radially from the sleeve, the lower end of the whip being secured in the socket; the link being pivotally connected between the pull rod and the socket radially outwardly from the sleeve.

* * * * *